US009631911B2

(12) United States Patent
Jung et al.

(10) Patent No.: US 9,631,911 B2
(45) Date of Patent: Apr. 25, 2017

(54) LIFTING PLUG FOR HIGH EXPLOSIVE PROJECTILE CAPABLE OF FORMING VENT BY THERMAL FUSE

(71) Applicant: SOOA CORPORATION, Daejeon-si (KR)

(72) Inventors: Seon Tae Jung, Cheongju-si (KR); Yea Min Youn, Daejeon (KR); Seon Kyung Yun, Daejeon-si (KR)

(73) Assignee: SOOA Corporation, Daejeon-si (KR)

( * ) Notice: Subject to any disclaimer, the term of this patent is extended or adjusted under 35 U.S.C. 154(b) by 0 days.

(21) Appl. No.: 15/099,469

(22) Filed: Apr. 14, 2016

(65) Prior Publication Data

US 2017/0016705 A1 Jan. 19, 2017

(30) Foreign Application Priority Data

Jul. 15, 2015 (KR) ..... 10-2015-0100216

(51) Int. Cl.
*F41A 9/00* (2006.01)
*F42B 39/20* (2006.01)

(52) U.S. Cl.
CPC ..... *F42B 39/20* (2013.01)

(58) Field of Classification Search
CPC ..... F42B 39/20
USPC ..... 102/481
See application file for complete search history.

(56) References Cited

U.S. PATENT DOCUMENTS 3,665,857 A * 5/1972 Radnich ..... F42B 39/00 102/481
3,927,791 A * 12/1975 Hershberger ..... F22B 37/46 102/481

FOREIGN PATENT DOCUMENTS

JP 5-116698 5/1993
KR 10-1537904 7/2015

OTHER PUBLICATIONS

KIPO Office Action dated Nov. 29, 2016, for corresponding Korean Patent Application No. 10-2015-0100216 (4 pages).

* cited by examiner

*Primary Examiner* — Samir Abdosh
(74) *Attorney, Agent, or Firm* — Lewis Roca Rothgerber Christie LLP

(57) ABSTRACT

The present invention relates to a lifting plug for a high explosive projectile capable of forming a vent by a thermal fuse, in which the lifting plug is mounted to a front part of a shell of the high explosive projectile such that the vent can be formed in the lifting plug by the thermal fuse when unexpected accidents such as fires or terrorism occur during storage of the high explosive projectile, so the lifting plug can induce burning or deflagrating of the thermal fuse without allowing the high explosive projectile to be detonated or exploded by accumulated heat in the high explosive projectile due to the vent, thereby improving safety of the high explosive projectile.

4 Claims, 6 Drawing Sheets

LIFTING PLUG FOR HIGH EXPLOSIVE PROJECTILE CAPABLE OF FORMING VENT BY THERMAL FUSE

CROSS REFERENCE TO RELATED APPLICATION

The present application claims priority to Korean Patent Application No. 10-2015-0100216, filed Jul. 15, 2015, the entire contents of which is incorporated herein for all purposes by this reference.

DETAILED DESCRIPTION

Technical Field

The present invention generally relates to a lifting plug for a high explosive projectile capable of forming a vent by a thermal fuse. More particularly, the present invention relates to a lifting plug for a high explosive projectile capable of forming a vent by a thermal fuse, in which the lifting plug is mounted to a front part of a shell of the high explosive projectile such that the vent can be formed in the lifting plug by the thermal fuse when unexpected accidents such as fires or terrorism occur during storage of the high explosive projectile, so the lifting plug can induce burning or deflagrating of the thermal fuse without allowing the high explosive projectile to be detonated or exploded by accumulated heat in the high explosive projectile due to the vent, thereby improving safety of the high explosive projectile.

Background Art

Generally, a large size artillery projectile such as a 155 mm artillery projectile is carried or stored after a lifting plug is mounted to the artillery projectile. However, when unexpected accidents such as fires or terrorism occur, a detonation or an explosion of the artillery projectile may occur due to accumulated heat in the artillery projectile. Accordingly, humans may be injured or killed and property may be considerably damaged by the unexpected accidents.

To prevent the explosion and the detonation of the stored large size artillery projectile, an insensitive explosive such as a plastic bonded explosive (PBX) has been developed as a substitute for trinitrotoluene (TNT) or composition B (Comp-B), which is a conventional high explosive. However, the insensitive explosive is expensive, and thus is limited to applications in missile warheads.

Meanwhile, as an example of a conventional technology concerning a safety device of an artillery projectile, the patent document (Korean Patent Application No. 10-2014-0062183, filed May 23, 2014, entitled "Transportation Loop Having Thermal Fuse") filed by an applicant of the present invention discloses a transportation loop having a thermal fuse. As shown in the drawings of patent document, the transportation loop (also known as a lifting plug in the related art and referred to as the lifting plug hereinbelow) is mounted to a front part of a shell 10 of an artillery projectile by being screwed thereto with a fuze being removed from the front part, the lifting plug including: a handle part 24 and a threaded part 23, with a thermal fuse 20 connecting the handle part 24 and the threaded part 23, wherein the thermal fuse 20 includes: a metal casing 22; and explosives 21 charged in the metal casing 22. When the thermal fuse 20 burns, the handle part 24 is removed from the lifting plug by explosive power generated by the burning of the explosives 21, thereby forming a vent 26 in the lifting plug and inducing burning of the thermal fuse 20 even when the main charge 13 is ignited, and thus preventing the explosion of the artillery projectile.

However, according to the conventional technology, since the handle part 24 of the lifting plug is combined with the threaded part 23 by bolts provided on opposite sides of a lower part of the handle part 24, the bolts are required to support a weight of the shell 10. Further, the bolts may be removed from the handle part by explosive power generated by the explosives 21 in the thermal fuse 20, and thus the bolts may fly away like lethal projectiles.

Accordingly, it is necessary to solve the problems of the conventional technology in which the weight of the shell 10 may be applied to the bolts provided on the lower part of the handle part 24 when the artillery projectile is carried, and the bolts may be removed from the handle part 24 to fly away like lethal projectiles by the explosive power of the explosives 21 during ignition thereof due to a fire. Furthermore, it is required to develop a safety device for an artillery projectile that can achieve improved safety, whereby the safety device can induce the burning of the thermal fuse 20 without allowing the artillery projectile to be exploded by external shock.

The foregoing is intended merely to aid in the understanding of the background of the present invention, and is not intended to mean that the present invention falls within the purview of the related art that is already known to those skilled in the art.

Problems to be Solved by Embodiment of the Invention

Accordingly, the present invention has been made keeping in mind the above problems occurring in the related art. That is, the present invention is intended to propose a lifting plug for a high explosive projectile capable of forming a vent by a thermal fuse, in which the lifting plug is configured to prevent the weight of the shell of an artillery projectile from being applied to bolts provided on opposite sides of a handle part of the lifting plug when the artillery projectile is carried, thereby realizing safe handling of the artillery projectile. The present invention is further intended to propose a lifting plug for a high explosive projectile capable of forming a vent by a thermal fuse, in which the lifting plug is configured to induce burning or deflagrating of a thermal fuse without allowing the main charge to be ignited by accumulated heat in the artillery projectile, thereby improving safety of the artillery projectile.

Means for Solving the Problems

In order to achieve the above object, according to one aspect of the present invention, there is provided a lifting plug for a high explosive projectile capable of forming a vent by a thermal fuse, the lifting plug being mounted to a front part of a shell of the projectile by being screwed thereto with a fuze being removed from the front part, the lifting plug including: a plug body; a handle provided on the plug body; a window combined with the plug body by a bolt fastened to respective locking holes of the plug body and the window; and a thermal fuse charged under the bolt such that when the thermal fuse is ignited, the window can be removed from the plug body by explosive power generated by the thermal fuse, thereby forming a vent in the lifting plug and preventing ignition of a supplementary charge and a main charge of the projectile, and thus preventing an explosion of the projectile.

In addition, the thermal fuse may include: 20 to 40 parts by weight of nitroguanidine; 20 to 40 parts by weight of silver nitrate ($AgNO_3$); 30 to 50 parts by weight of molybdenum (Mo); and 0.1 to 2 parts by weight of diphenylamine.

Furthermore, the thermal fuse may be ignited at temperatures between 115° C. and 130° C., which are lower than ignition temperatures of the main charge.

Lastly, the thermal fuse may weigh between 0.1 g and 0.3 g, and is pellet-shaped.

Effect of the Embodiment of the Invention

The lifting plug for the high explosive projectile capable of forming the vent by the thermal fuse according to the present invention has the following effects.

1) The window can be removed from the plug body by explosive power generated in the lifting plug by the thermal fuse ignited at temperatures lower than temperatures at which the main charge and the supplementary charge are ignited. Accordingly, the plug body can form the vent therein, and thus burning or deflagrating of the thermal fuse is induced without explosion of the high explosive projectile, which improves safety of the high explosive projectile.

2) Since the bolt fastened to a locking hole of the window of the lifting plug remains connected to the window without being removed from the window during the explosion of the thermal fuse, the lifting plug is safe.

3) Since the handle of the lifting plug is formed integrally with the plug body, the weight of the shell is not applied to the bolt, the lifting plug is safe to handle.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
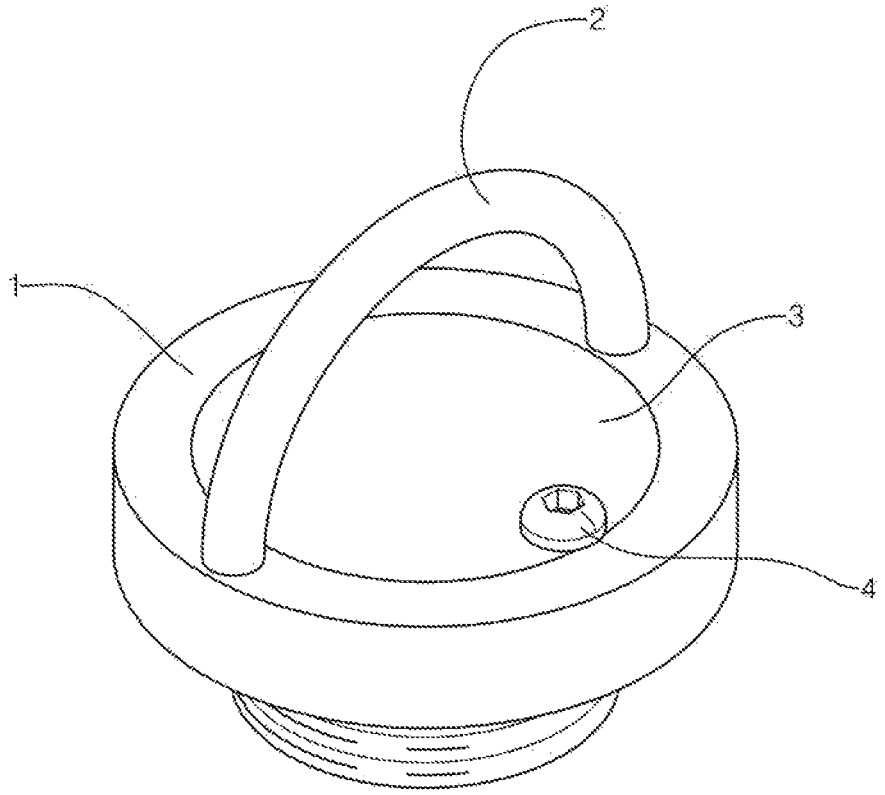
FIG. 1 is a perspective view of a lifting plug for a high explosive projectile capable of forming a vent by a thermal fuse according to the present invention.

Hereinbelow, a high explosive projectile capable of forming a vent by thermal fuse according to the present invention will be described in detail with reference to FIGS. 1 to 6 of the accompanying drawings.

According to a lifting plug for a high explosive projectile capable of forming a vent by thermal fuse of the present invention, the lifting plug being mounted to a front part of a shell of the projectile by being screwed thereto with a fuze being removed from the front part includes: a plug body 1; a handle 2 provided on the plug body 1; a window 3 combined with the plug body 1 by a bolt 4 fastened to respective locking holes 5 and 5' of the plug body 1 and the window 3; and a thermal fuse 7 charged under the bolt 4 such that when the thermal fuse 7 is ignited, the window 3 can be removed from the plug body 1 by explosive power generated by the thermal fuse 7, thereby forming a vent 6 in the lifting plug and preventing ignition of a supplementary charge 8 and a main charge 10 of the projectile, and thus preventing an explosion of the projectile.

A large size artillery projectile such as a 155 mm artillery projectile is carried or stored after a lifting plug is mounted to a front part of the artillery projectile with a fuze being removed from the front part. However, when unexpected accidents such as fires or terrorism occur, a detonation or an explosion of the artillery projectile may occur due to accumulated heat in the artillery projectile. Accordingly, humans may be injured or killed and property may be considerably damaged by the unexpected accidents. Accordingly, the lifting plug of the present invention is presented as a safety device to prevent the above-mentioned problem.

The lifting plug is required to improve safety of the projectile by allowing burning or deflagrating of the thermal fuse 7 to be induced without allowing the main charge 10 to be ignited by the accumulated heat in the projectile when unexpected accidents such as fires or terrorism occur during storage of the projectile. To this end, as shown in FIG. 3, the lifting plug of the present invention may be easily mounted to the front part of the shell of the projectile by being screwed thereto with the fuze being removed from the front part.

Figure 2:
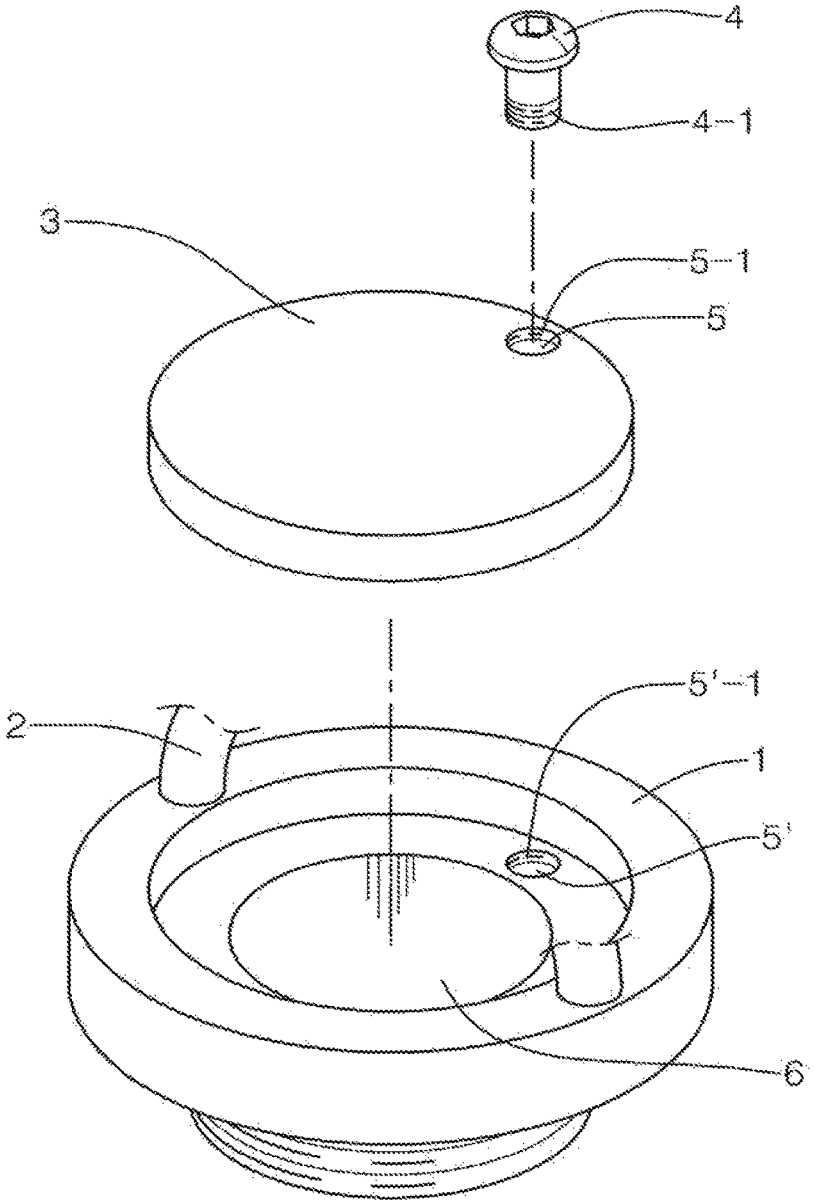
FIG. 2 is an exploded perspective view of the lifting plug according to the present invention.

As shown in FIGS. 1 and 2, the lifting plug includes the plug body 1, the handle 2, and the window 3, and the plug body 1 is combined with the window 3 by a bolt 4 fastened to respective locking holes 5 and 5' of the plug body 1 and the window 3.

Figure 3:
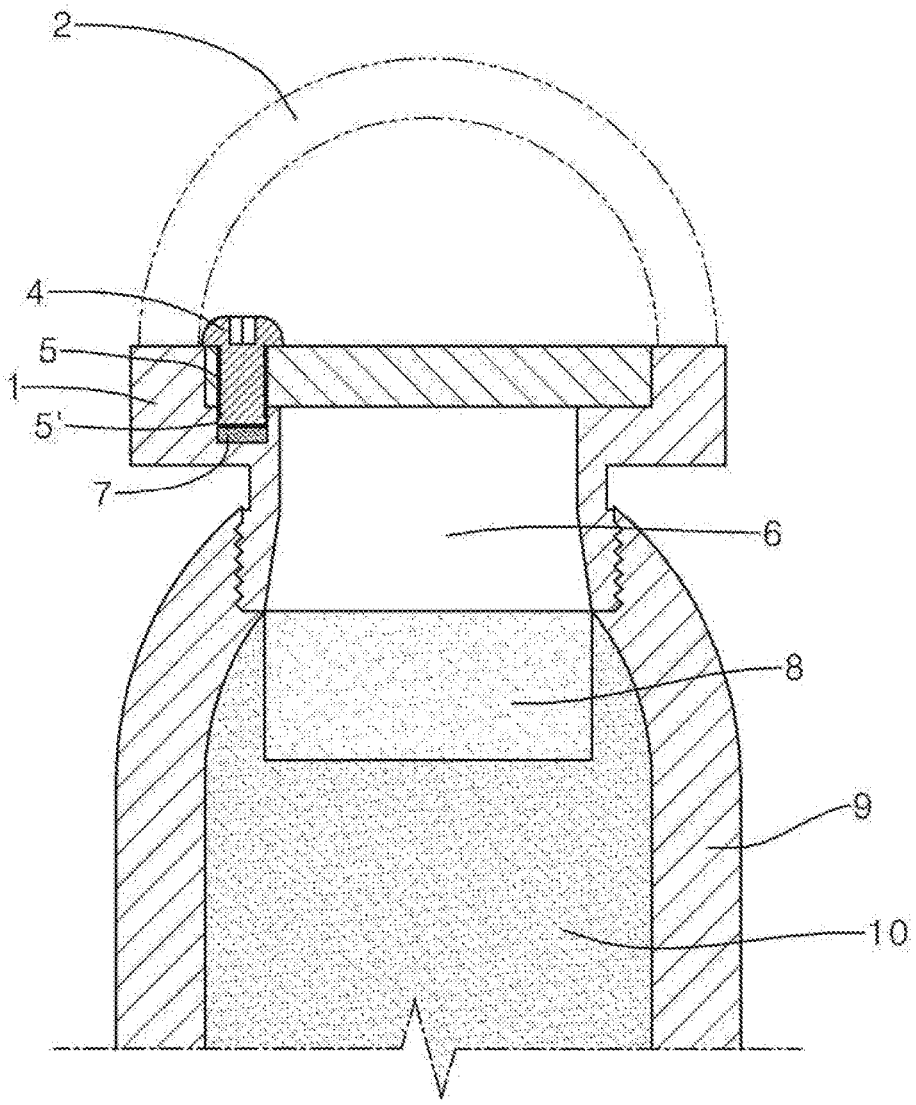
FIG. 3 is a sectional view showing a state of the lifting plug mounted to a front part of a shell of the projectile according to the present invention.
Figure 4:
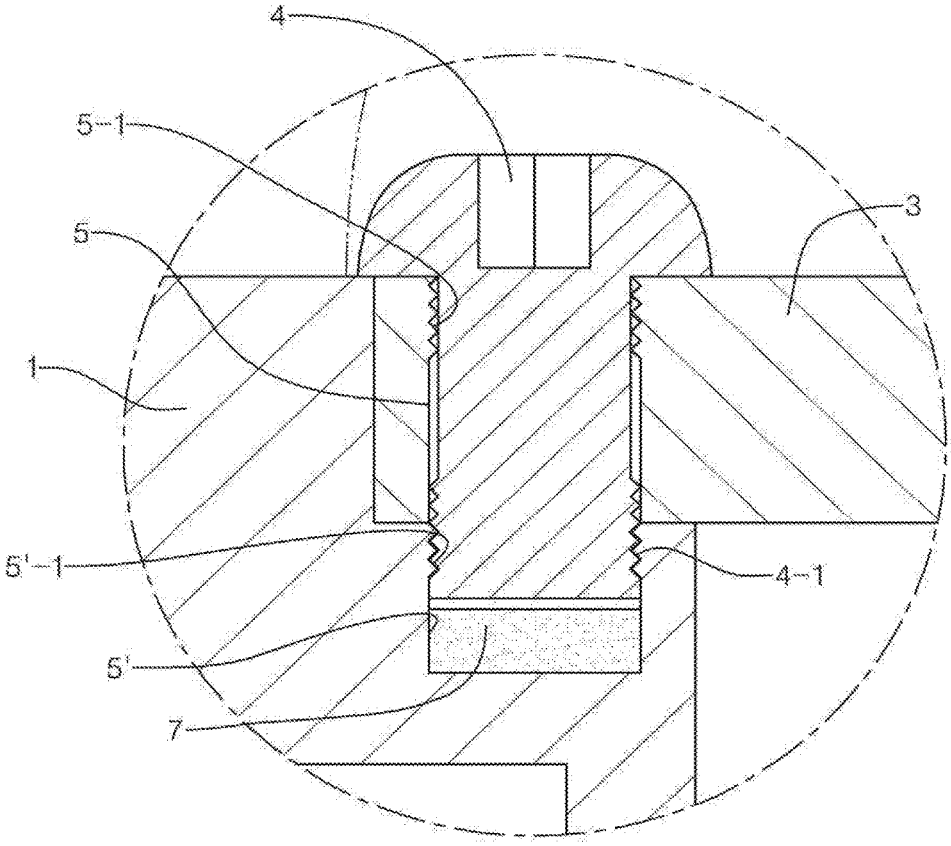
FIG. 4 is a sectional view showing a state of a bolt fastened to respective locking holes of a window and a plug body of the lifting plug.
Figure 5:
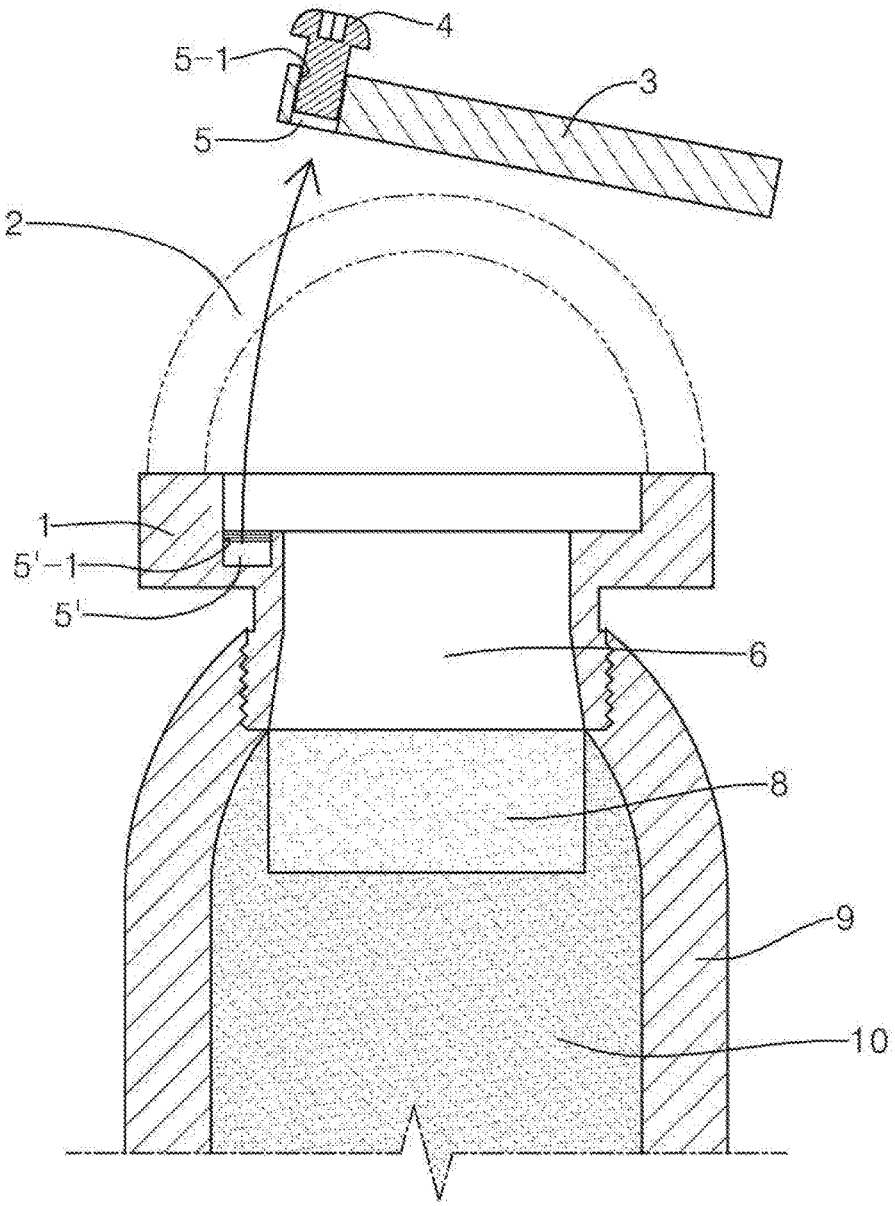
FIG. 5 is a sectional view showing a state of a vent formed by the window removed from the plug body due to ignition of the thermal fuse according to the present invention.

In addition, as shown in FIG. 3, the thermal fuse 7 is charged under the bolt 4. As shown in FIG. 5, when the thermal fuse 7 is ignited, the window 3 is removed from the plug body 1 to the outside of the handle 2 by explosive power generated due to ignition of the thermal fuse 7, and thus the vent 6 is formed in the plug body 1. Accordingly, the supplementary charge 8 and the main charge 10 of the projectile are not ignited, and thus the explosion of the projectile can be prevented.

When the unexpected accidents such as fires or terrorism occur during storage of the projectile, the thermal fuse 7 is ignited and burned at temperatures between 115° C. and 130° C. Accordingly, it is preferred that the window 3 is combined with the plug body 1 by the bolt 4 such that the window 3 provided at the center of the lifting plug may be easily removed from the lifting plug to the outside of the handle 2 by a strong pressure generated due to burning of the thermal fuse 7.

Preferably, the thermal fuse 7 includes: 20 to 40 parts by weight of nitroguanidine; 20 to 40 parts by weight of silver nitrate ($AgNO_3$); 30 to 50 parts by weight of molybdenum (Mo); and 0.1 to 2 parts by weight of diphenylamine. The thermal fuse 7 weighs between 0.1 g and 0.3 g, and is pellet-shaped.

The roles of the components constituting the thermal fuse 7 will be described below. Nitroguanidine is a nitramine-based synthesized explosive and is used as a propellant charge for artillery, and silver nitrate ($AgNO_3$) functions as an oxidizing agent supplying oxygen required during explosion of the thermal fuse 7. Additionally, molybdenum (Mo) is used as a supplementary energy source, and diphenylamine functions as a stabilizer.

How the lifting plug operates will be described below. The thermal fuse 7 includes: 20 to 40 parts by weight of nitroguanidine; 20 to 40 parts by weight of silver nitrate ($AgNO_3$); 30 to 50 parts by weight of molybdenum (Mo); and 0.1 to 2 parts by weight of diphenylamine, and the thermal fuse 7 is ignited at temperatures between 115° and 130° C. Compared to the thermal fuse 7 ignited at temperatures between 115° C. and 130'C, the main charge 10 and the supplementary charge 8 charged in the projectile are trinitrotoluene (TNT) and are ignited at a temperature of 300° C.

In addition, the thermal fuse 7 is ignited at temperatures between 115° C. and 130° C., which are lower than temperatures between 150° C. and 160° C. that are the ignition temperatures of a thermal fuse 21 used in a lifting plug having a thermal fuse disclosed in Korean Patent Application No. 10-2014-0062183 filed by the applicant of the present invention on May 23, 2014, wherein the thermal fuse 21 includes: 20 to 50 parts by weight of N-guanyl ureadinitramide (GUDN), 30 to 60 parts by weight of 3-nitro-1,2,4-triazole-5-one (NTO), 10 to 20 parts by weight of potassium nitrate ($KNO_3$), and 1 to 5 parts by weight of Boron (B). Accordingly, the thermal fuse 7 can be used more safely than the thermal fuse 21.

Figure 6:
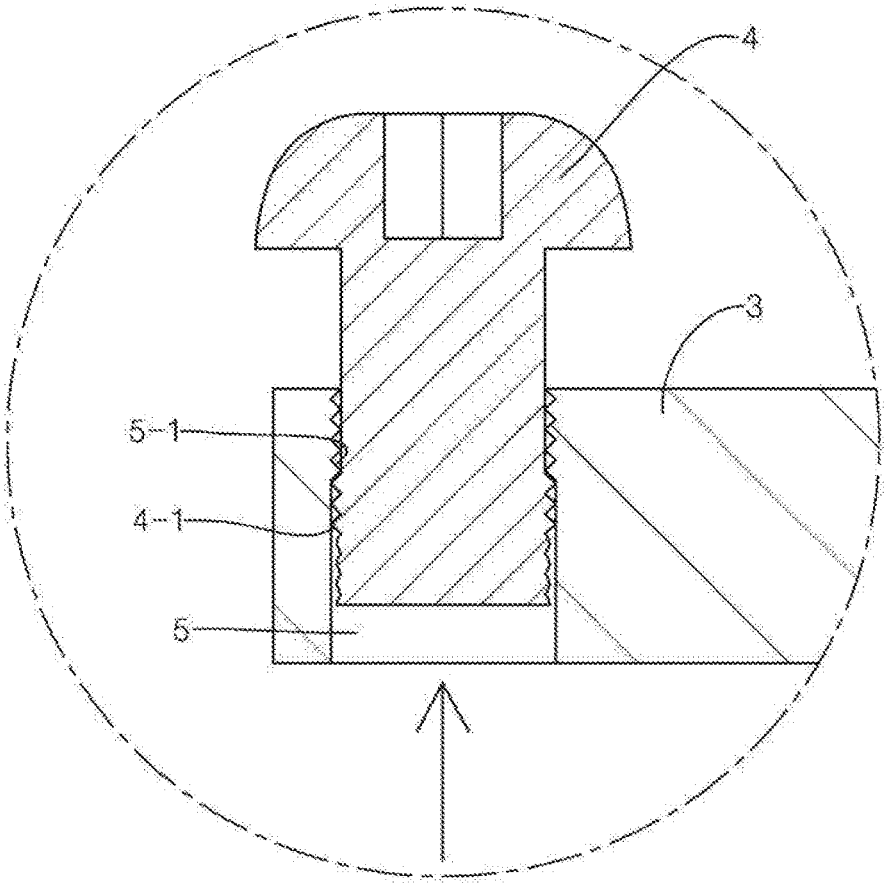
FIG. 6 is a sectional view showing the state that window is removed by the bolt.

Accordingly, when heat is accumulated in the projectile due to fires, the thermal fuse 7 is ignited and burned before the main charge 10 and the supplementary charge 8 are ignited and burned since ignition temperatures of the thermal fuse 7 are between 115' and 130° C., and are lower than ignition temperatures of the main charge 10 and the supplementary charge 8. Additionally, as shown in FIGS. 5 and 6, the window 3 mounted at the center of the lifting plug, along with the bolt 4, flies away to the outside of the handle 2 by the strong pressure generated during the ignition and burning of the thermal fuse 7, and is removed from the plug body 1. At the same time, since the bolt 4 remains connected to the window 3 without being removed therefrom, the lifting plug is safe in handling the artillery projectile.

Accordingly, since the vent 6 is formed on an upper part of the projectile, the main charge 10 and the supplementary charge 8 are not ignited. Furthermore, since risk factors that may occur during storage of the projectile can be removed, the projectile can be kept safe without being detonated or exploded.

Although the present invention is limited to the above-mentioned embodiment for describing purposes, those skilled in the art will appreciate that various modifications, additions and substitutions are possible, without departing from the scope and spirit of the present invention as disclosed in the accompanying claims. For example, during storage of a projectile, a lifting plug charged with a thermal fuse may be mounted to a shell of the projectile that is not fired, thereby forming a vent in the lifting plug in the same manner as the lifting plug of the present invention, and improving safety against fire accidents during storage of the projectile.

What is claimed is:

1. A lifting plug for a high explosive projectile capable of forming a vent by a thermal fuse, the lifting plug being mounted to a front part of a shell of the projectile by being screwed thereto with a fuze being removed from the front part, the lifting plug comprising:

(a) a plug body;

(b) a handle provided on the plug body;

(c) a window combined with the plug body by a bolt fastened to respective locking holes of the plug body and the window; and (d) a thermal fuse charged under the bolt such that when the thermal fuse is ignited, the window can be removed from the plug body by explosive power generated by the thermal fuse, thereby forming a vent in the lifting plug and preventing ignition of a supplementary charge and a main charge of the projectile, and thus preventing an explosion of the projectile.

2. The lifting plug of claim 1, wherein the thermal fuse comprises: 20 to 40 parts by weight of nitroguanidine; 20 to 40 parts by weight of silver nitrate ($AgNO_3$); 30 to 50 parts by weight of molybdenum (Mo); and 0.1 to 2 parts by weight of diphenylamine.

3. The lifting plug of claim 2, wherein the thermal fuse is ignited at temperatures between 115° C. and 130° C.

4. The lifting plug of claim 3, wherein the thermal fuse weighs between 0.1 g and 0.3 g, and is pellet-shaped.

* * * * *